US011111119B2

(12) United States Patent
Andersen et al.

(10) Patent No.: US 11,111,119 B2
(45) Date of Patent: Sep. 7, 2021

(54) HYDRAULIC POWER UNIT FOR JACK WITH INTERNALLY ADJUSTABLE SAFETY RELIEF VALVE

(71) Applicant: Snap-on Incorporated, Kenosha, WI (US)

(72) Inventors: Jonathan I. Andersen, Mount Pleasant, WI (US); Benjamin T. Schulz, Oak Creek, WI (US); Daniel M. Eggert, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 575 days.

(21) Appl. No.: 16/101,754

(22) Filed: Aug. 13, 2018

(65) Prior Publication Data

US 2020/0048057 A1 Feb. 13, 2020

(51) Int. Cl.
*B66F 5/04* (2006.01)
*B66F 3/42* (2006.01)

(52) U.S. Cl.
CPC . *B66F 5/04* (2013.01); *B66F 3/42* (2013.01)

(58) Field of Classification Search
CPC ..... B66F 3/24; B66F 3/25; B66F 3/26; B66F 3/42; B66F 5/04
USPC ..... 60/481, 482
See application file for complete search history.

(56) References Cited

U.S. PATENT DOCUMENTS

| | | | | |
|---|---|---|---|---|
| 2,435,326 | A | 3/1945 | Schwerin | |
| 2,625,796 | A | 2/1950 | Traut | |
| 2,696,850 | A | 6/1950 | Peterson | |
| 3,283,722 | A | 11/1966 | Helms | |
| 3,410,087 | A | 11/1968 | Arnes | |
| 3,757,523 | A | 9/1973 | Resuggan | |
| 4,131,263 | A | 12/1978 | John | |
| 4,151,720 | A | 5/1979 | Vanderstappen | |
| 4,703,916 | A | 11/1987 | Hung | |
| 4,825,755 | A | 5/1989 | Takano | |
| 5,499,655 | A | 3/1996 | Hung | |
| 5,542,252 | A | 8/1996 | Hung | |
| 6,247,307 | B1 | 6/2001 | Hung | |
| 6,295,812 | B1 | 10/2001 | Hsu | |
| 7,036,796 | B2 * | 5/2006 | Hsu | B66F 5/04 254/8 B |

FOREIGN PATENT DOCUMENTS

| | | |
|---|---|---|
| CN | 200989211 Y | 12/2007 |
| CN | 201769188 U | 3/2011 |

(Continued)

OTHER PUBLICATIONS

Search and Examination Report for Application No. GB1902096.5 dated Aug. 14, 2019, 5 pages.

(Continued)

*Primary Examiner* — Tyrone V Hall, Jr.
*Assistant Examiner* — Abbie E Quann
(74) *Attorney, Agent, or Firm* — Seyfarth Shaw LLP

(57) ABSTRACT

A hydraulic power unit for a floor jack that includes an internally-adjustable relief valve that is inaccessible to an operator without removing the power unit from the jack assembly and disassembling the power unit. By placing the relief valve inside of the hydraulic assembly, hidden from operators, the relief valve is less likely to be accidently adjusted when using or servicing the jack.

11 Claims, 5 Drawing Sheets

(56) References Cited

FOREIGN PATENT DOCUMENTS

| | | | |
|---|---|---|---|
| CN | 203411280 | U | 1/2014 |
| CN | 207002113 | | 2/2018 |
| EP | 0841299 | A1 | 5/1998 |
| GB | 1470319 | A | 4/1977 |
| TW | 389242 | | 5/2000 |
| TW | 390363 | U | 5/2000 |
| TW | 500123 | U | 8/2002 |
| WO | 02083545 | A1 | 10/2002 |
| WO | 2002083545 | A1 | 10/2002 |

OTHER PUBLICATIONS

Australian Examination Report for Application No. 2019201089 dated Sep. 6, 2019, 7 pages.
Taiwan Office Action for Application No. 108114102 dated Sep. 10, 2019, 3 pages.
Canadian Office Action for Application No. 3,035,718 dated Nov. 4, 2020, 5 pages.
Chinese Office Action for Application No. 201910281875.6 dated Oct. 21, 2020, 8 pages.
UK Office Action for Application No. GB1902096.5 dated Nov. 3, 2020, 2 pages.
Canadian Office Action for Application No. 3,035,718 dated Feb. 25, 2020, 8 pages.

* cited by examiner

HYDRAULIC POWER UNIT FOR JACK WITH INTERNALLY ADJUSTABLE SAFETY RELIEF VALVE

TECHNICAL FIELD OF THE INVENTION

The present application relates generally to jacks. More particularly, the present invention relates to hydraulic power units for jacks with safety relief valves.

BACKGROUND OF THE INVENTION

Floor jacks are used in repair shops to lift a vehicle from the ground. An operator positions the floor jack underneath a lift point and raises the vehicle at that point. Floor jacks can be powered by manual or automated means, and have become important to the automotive repair industry.

Shop floor jacks are sometimes manufactured with internally-relieved hydraulic systems to limit lifting load output. This is a feature for floor jacks that may be used to meet the American Society of Mechanical Engineers Portable Automotive Service Equipment (PASE) standards. These valves are normally adjustable via a relief screw exposed to the outside of the valve block via a port. The relief valve adjustment port is commonly located in close proximity to other bolt heads and fill-port caps, which can lead to confusion for the operator, who may mistakenly access the port and adjust the relief valve by mistake. Such uncalibrated adjustments can result in failure of the jack to lift its rated load, or worse, may allow the jack to lift more than it's rated capacity, resulting in failure, property damage, and personal injury.

SUMMARY OF THE INVENTION

The present invention relates broadly to a floor jack and a hydraulic power unit for the floor jack with an internally-adjustable relief valve that is inaccessible to an operator without removing the power unit from the jack assembly and disassembling the power unit. By placing the relief valve inside of the hydraulic assembly, hidden from operators, the operator cannot inadvertently adjust the relief valve when looking to add fluid or perform other service to the jack's power unit. Nonetheless, the relief valve is adjustable, so the power unit can be properly calibrated and set during product assembly, refurbishment, and repair. Access to the relief valve requires accessing the inside of the pump, requiring the removal of the power unit from the jack assembly, and disassembly of the power unit to access the interior of the valve block itself.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
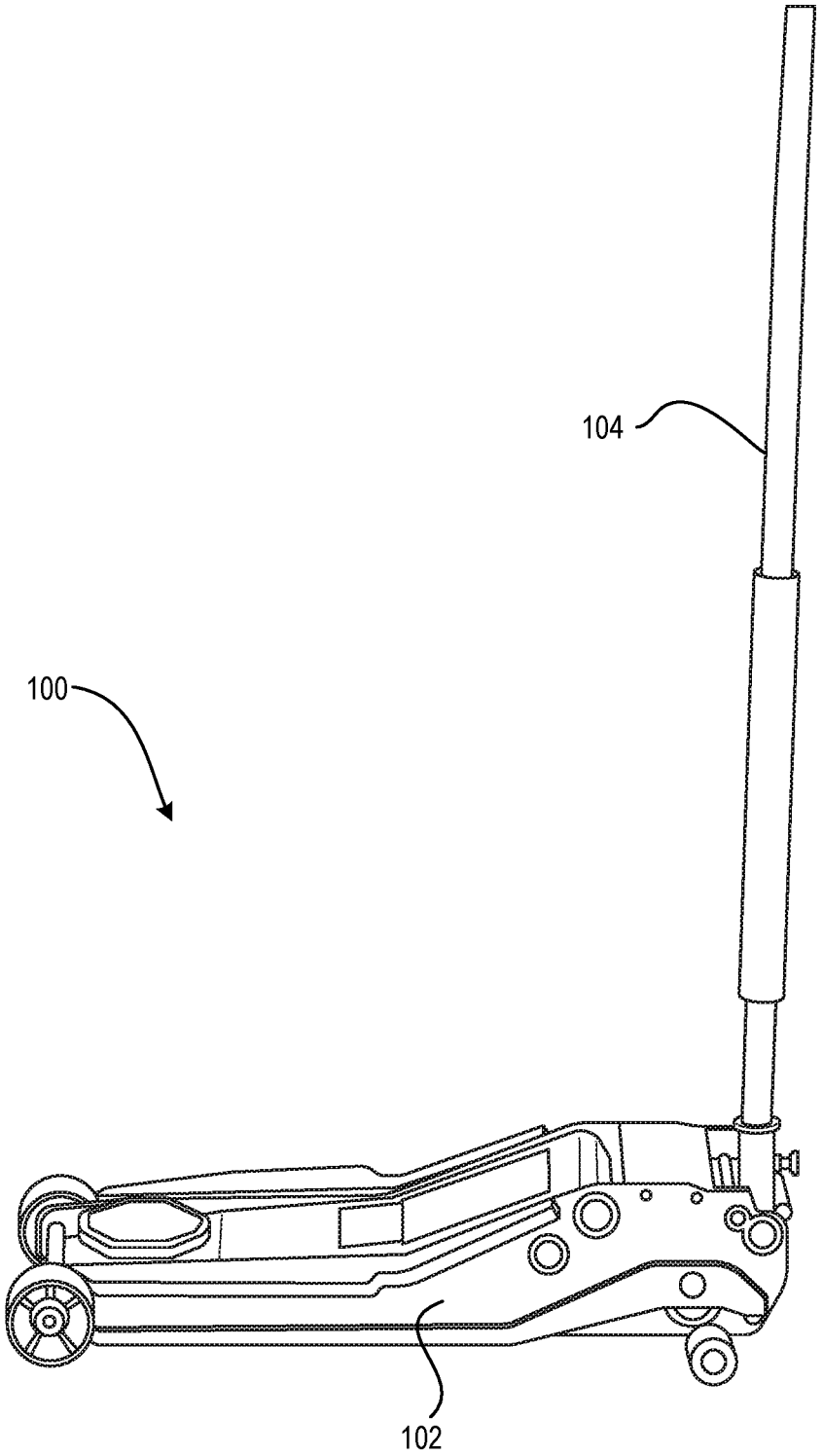
FIG. 1 is an assembled view of a jack incorporating an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to a floor jack and a hydraulic power unit for the floor jack with an internally-adjustable relief valve that is inaccessible to an operator without removing the power unit from the jack assembly and disassembling the power unit. By placing the relief valve inside of the hydraulic assembly, hidden from operators, an operator cannot inadvertently adjust the relief valve when looking to add fluid or perform other service to the jack's power unit. Nonetheless, the relief valve is adjustable, so the power unit can be properly calibrated and set during product assembly, refurbishment, and repair. Access to the relief valve requires accessing the inside of the pump, requiring the removal of the power unit from the jack assembly, and disassembly of the power unit to access the interior of the valve block itself.

Figure 2:
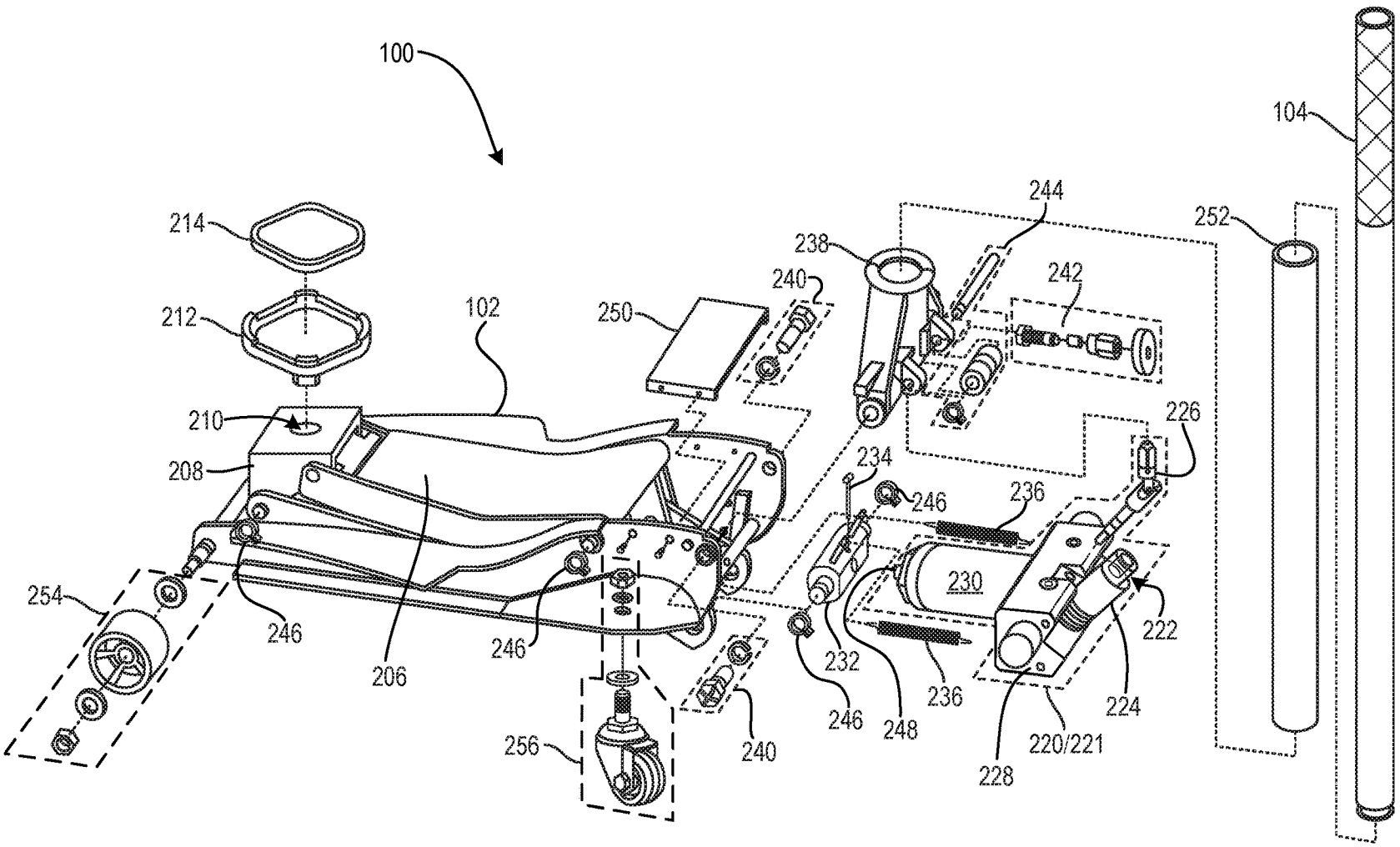
FIG. 2 is a disassembled, exploded perspective view of the jack of FIG. 1.

Referring to FIGS. 1 and 2, a jacking mechanism includes a handle 104 operably coupled to a lifting arm 206 that is coupled to and movable relative to the frame 102 in response to motion of the handle 104. A saddle base 208 is coupled to the lifting arm 206 and moves with the lifting arm 206 in response to motion of the handle 104, allowing the saddle base 208 to raise a vehicle. The saddle base 208 may include an opening 210 that receives a stalk or other connector extending from an underside of a saddle 212. A pad 214 may be included on a vehicle-facing surface of the saddle 212 to help avoid marring or damaging the vehicle. The saddle 212 and pad 214 may be changeable to accommodate different types of lift points, depending upon the vehicle.

The hydraulics of the jack 100 are part of a power unit 220 or a power unit 221, depending upon the internal configuration of the power unit. The power unit 220/221 includes a drive piston 222 slidably mounted in a fluid cylinder 224 to compress/pump fluid within the fluid cylinder 224, and a release valve mechanism 226. Externally, the power unit 220 and the power unit 221 are similar. A valve block 228 of the power unit 220/221 is coupled to the frame 102, and a lift piston 248 that is slidable within a lift-piston assembly 230 of the power unit 220/221 is coupled to a trunnion block 232, which is coupled to the lift piston 248 (such as by a cotter pin 234).

The trunnion block 232 is coupled to the lifting arm 206. Pressure on the hydraulic fluid generated in the fluid cylinder 224 is transferred by the valve block 228 into the lift-piston assembly 230, to push against the lift piston 248 in the piston assembly 230. This generates a unidirectional force as the lift piston 248 pushes against the trunnion block 232. The trunnion block 232 transfers the force from the lift piston 248 to the lifting arm 206, causing the saddle base 208 to rise.

A handle yoke 238 is pivotably coupled to the frame 102 by pivot bolts 240. The handle 104 is inserted into and coupled to the handle yoke 238 via a retaining pin 242. A yolk pump roller assembly 244 is coupled to the handle yolk 238, and disposed or positioned so that when the handle 104 is pushed or pumped, a roller of the roller assembly 244 compresses the drive piston 222, creating hydraulic pressure within the fluid cylinder 224. A spring (not illustrated) may be compressively mounted around the periphery of the drive piston 222, or enclosed within the fluid cylinder 224, to cause the drive piston 222 to rebound from the fluid cylinder 224 for the upstroke during pumping.

Depending on how the release valve mechanism 226 and the handle yoke 238 are configured, moving the handle 104 forwardly or twisting the handle 104 pulls on the release valve mechanism 226, causing the release valve mechanism 226 to release the hydraulic pressure within the power unit 220/221. Springs 236 may be disposed between the trunnion block 232 and the frame 102 to compress the lift piston 248 back into the piston assembly 230, creating reverse pressure on the hydraulic fluid in the piston assembly 230 so that the saddle base 208 descends when the release valve mechanism 226 is opened, even if there is no load on the jack 100.

Various components of the jack may be coupled in place, among other ways, using retaining rings 246. Once the jack 100 is assembled, a cover plate 250 may be coupled to the frame 102 to shield the internal components. An end of the handle 104 may be knurled or textured to provide a grip surface. As an additional grip surface, a handle pad 252 (e.g., foam) may be disposed over the handle 104. The jack 100 may have wheels for ease-of mobility. FIG. 2 illustrates one-of-two front wheel assemblies 254, and one-of-two rear wheel assemblies 256, mounted to the frame 102. However, it should be appreciated that the wheels may be replaced by a singular roller.

Figure 3:
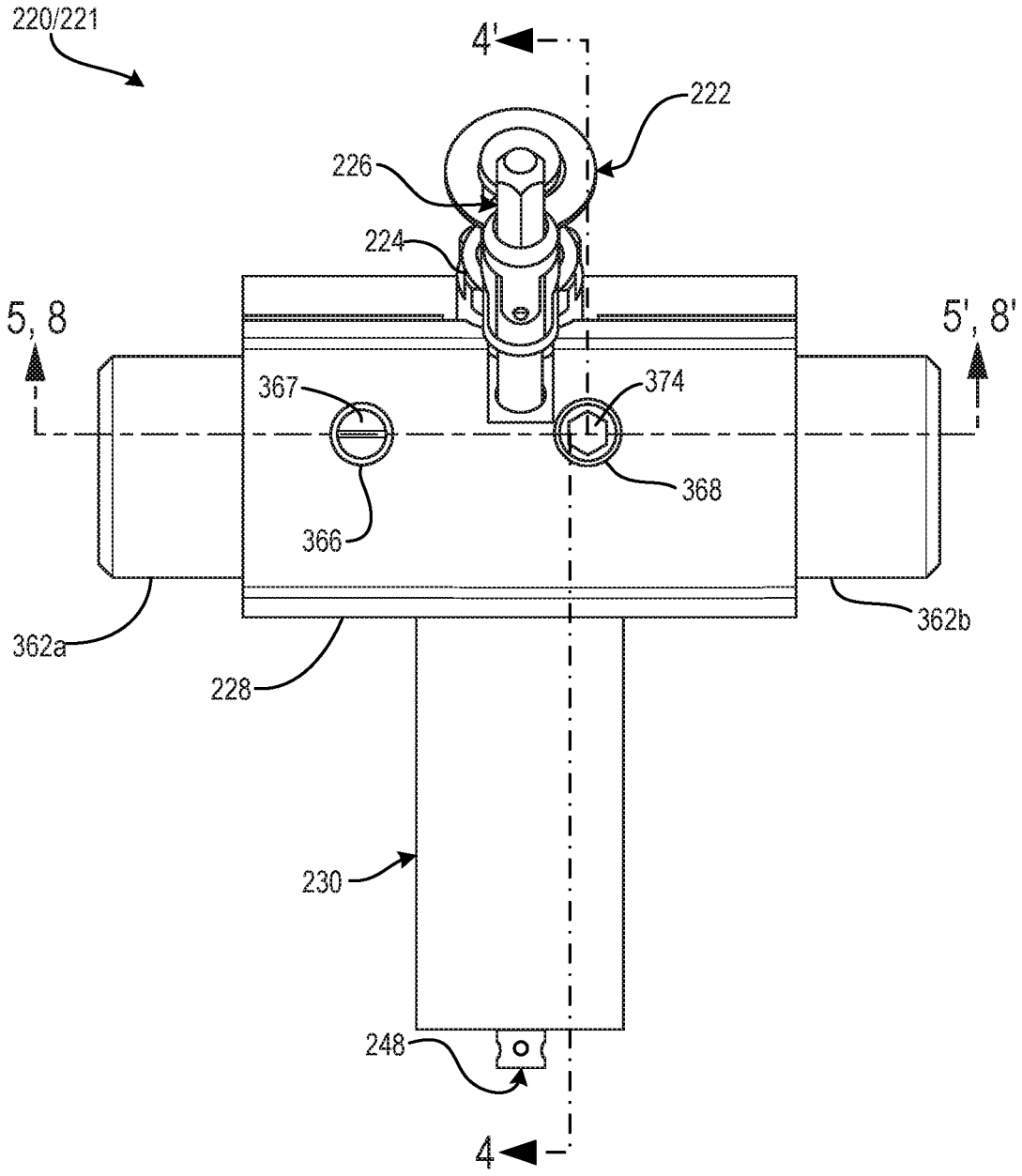
FIG. 3 is a top view of a power unit of according to an embodiment of the present invention.
Figure 4:
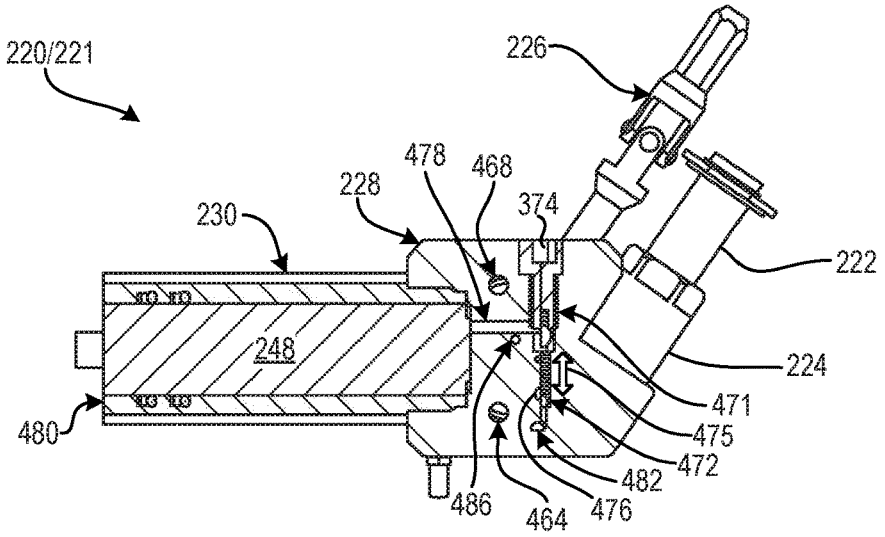
FIG. 4 is a cross-sectional view of the power unit along the line 4-4' in FIG. 3.
Figure 5:
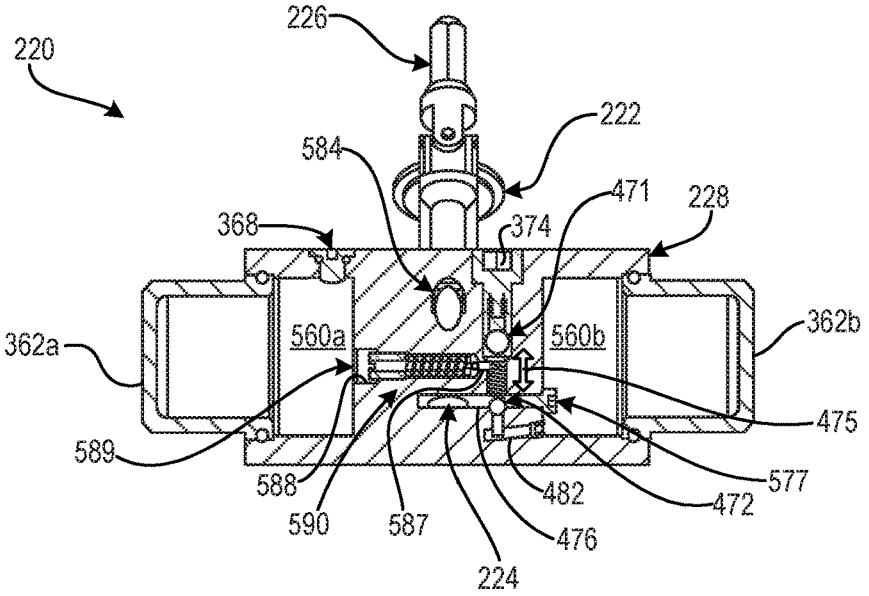
FIG. 5 is a cross-sectional view of the power unit along the line 5-5' in FIG. 3.

The power unit 220/221 includes a fluid reservoir/tank, formed in part by a first reservoir cap 362*a* and a second reservoir cap 362*b* on opposite sides of the valve block 228. As shown in FIG. 5, the valve block 228 includes a first recess 560*a* and a second recess 560*b* on opposite sides of a long axis of the piston assembly 230. As shown in FIGS. 3 and 5, an open face of the first recess 560*a* is enclosed by the first reservoir cap 362*a*, and an open face of the second recess 560*b* is enclosed by the second reservoir cap 362*b*. Through-bores 464 and 468 (FIG. 4) through the valve block 228 fluidly couples the first recess 560*a* and the second recess 560*b*, providing a passage for the free-flow of fluid within the reservoir/tank formed by the combined recesses 560*a/b*, caps 362*a/b*, and through-bores 464 and 468.

A threaded through-bore 366 in the upper surface of the valve block 228 provides a port opening into the first recess 560*a*, via which hydraulic fluid may be added to the reservoir/tank. The threaded through-bore 366 is sealed by a threaded fill plug 367.

Another port in the upper surface of the valve block 228 is a vertical bore hole 368 containing a vertically-oriented lift cylinder check valve 471 and a vertically-oriented vacuum-to-tank check valve 472. A threaded plug 374 over the lift cylinder check valve 471 seals the external port at the top of the vertical bore hole 368. The sealed vertical bore hole 368 provides an internal vertical passage 475 for the flow of hydraulic fluid within the valve block 228.

The lift cylinder check valve 471 includes a bias member (such as a spring) and ball, with the ball located in the vertical passage 475 between a first horizontal passage 476 and a second horizontal passage 478. The first horizontal passage 476 connects the fluid cylinder 224 to the vertical passage 475. The first horizontal passage 476 may be formed as a bore hole in the valve block 228 that extends inward from the second recess 560*b*, to intersect the vertical passage 475 and a base of the fluid cylinder 224. The port of the bore hole forming the first horizontal passage 476 opens into the second recess 560*b* and is sealed, such as by a threaded plug 577. The first horizontal passage 476 provides a fluid pathway between the fluid cylinder 224 and the lift cylinder check valve 471, and vacuum-to-tank check valve 472 disposed in the vertical passage 475. The second horizontal passage 478 is a bore hole in the valve block 228 that extends from the back of the piston assembly 230 to an upper-end of the vertical passage 475.

To lift a vehicle, movement of the handle 104 actuates the drive piston 222, compressing the fluid in the fluid cylinder 224. Pressure generated in the fluid cylinder 224 reaches the lift cylinder check valve 471 via the first horizontal passage 476, causing the lift cylinder check valve 471 to open so that hydraulic fluid flows through the second horizontal passage 478 into the lift cylinder 480 of the piston assembly 230. The pressure at the back of the lift cylinder 480 pushes against the lift piston 248, with the resulting force mechanically transferred to the lift arm 206 by the trunnion block 232.

When the pressure from the drive piston 222 and fluid cylinder 224 decreases, such as during an uptake of the handle 104 during pumping, the lift cylinder check valve 471 closes, to prevent the hydraulic fluid from flowing out of the lift cylinder 480 via the second horizontal passage 478. Also, if the reverse pressure on the hydraulic fluid in the piston assembly 230 exceeds the pressure generated by the fluid cylinder 224, the lift cylinder check valve 471 may not open in response to actuation of the drive piston 222.

The bottom of the vertical passage 475 connects to a fluid intake passage 482. The fluid intake passage 482 includes a bore hole in the valve block 228 extending from the bottom of the second recess 560*b* to the bottom of the vertical passage 475. The vacuum-to-tank check valve 472 includes a bias member (such as a spring) and ball, located in the vertical passage 475 beneath the lift cylinder check valve 471. The ball of the vacuum-to-tank check valve 472 is disposed or positioned between the junction of the first horizontal passage 476 with the vertical passage 475, and the intake passage 482, to selectively open and close off the intake passage 482.

As the drive piston 222 rises after an uptake of the handle 104 during pumping, the drop in fluid pressure causes the vacuum-to-tank check valve 472 to open, with hydraulic fluid flowing from the reservoir/tank into the fluid cylinder 224. Specifically, hydraulic fluid flows from the reservoir/tank into the intake passage 482, through the open valve 472, and into the second horizontal passage 478, to be sucked into the fluid cylinder 224. When the fluid pressure in the fluid cylinder 224 increases, such as when the handle 104 actuates the drive piston 222, the vacuum-to-tank check valve 472 closes, preventing the flow of hydraulic fluid back into the reservoir/tank via the intake passage 482.

An external port of a diagonal though-bore 584 through the valve block 228 receives the release valve mechanism 226, with a portion of the release valve mechanism being within the diagonal through-bore 584, and another portion being external to the valve block 228. The end of the diagonal though-bore 584 opposite the external port opens into the back of the lift cylinder 480 of the piston assembly 230. Between the piston assembly 230 and the exterior port, the diagonal through-bore 584 intersects a third horizontal passage 486. The third horizontal passage 486 is formed as a bore through the valve block 228, and fluidly connects the diagonal though-bore 584 to one or both of the first and second recesses 560*a*, 560*b*.

During lifting, the release valve mechanism 226 closes off the third horizontal passage 486. To lower the saddle base 208, the release valve mechanism 226 is pulled outward, opening the third horizontal passage 486. This creates a pressure-release pathway from the piston assembly 230 through the diagonal though-bore 584 to the third horizontal passage 486, into the tank/reservoir. When open, hydraulic fluid evacuates the lift cylinder 480 via this pressure-release pathway.

As shown in FIG. 5, a fourth horizontal passage 587 through the valve block 228 connects the first recess 560*a* to the vertical passage 475, intersecting the vertical passage 475 between the ball of the lift cylinder check valve 471 and the first horizontal passage 476. Opposite the connection to the vertical passage 475, the bore-hole forming the fourth horizontal passage 587 widens into a cavity 588 that opens into the first recess 560*a* as an internal port 589. An adjustable relief valve 590 is disposed in or integrated within the cavity 588 of the fourth horizontal passage 587, and is accessible via the internal port 589.

Figure 6:
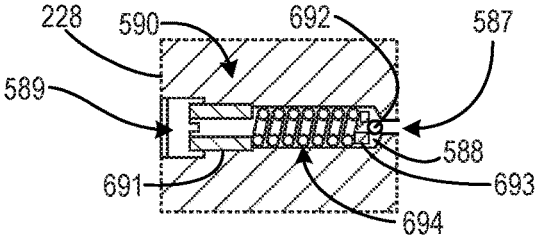
FIG. 6 is an expanded cross-sectional view of an integrated adjustable relief valve in the power unit of FIG. 5.

FIG. 6 is an expanded cut-away view of the fourth horizontal passage 587 and the adjustable relief valve 590. The adjustable relief valve 590 is oriented horizontally in the cavity 588. An externally-threaded hollow relief screw 691 is accessible within the internal port 589 at the back of the first recess 560*a*. When the first recess 560*a* is enclosed and sealed by the first reservoir cap 362*a*, the hollow relief screw 691 is not externally visible nor externally accessible.

The adjustable relief valve 590 includes the hollow relief screw 691, a ball 692, a valve seat 693, and a bias member 694 (such as a spring). Movement of the ball 692 opens and closes the valve 590. Specifically, the ball 692 selectively closes off an aperture in the fourth horizontal passage 587, where the fourth horizontal passage 587 narrows at the back of the cavity 588 to connect to the vertical passage 475.

One side of the valve seat 693 presses the ball 692 against the aperture, while the bias member 694 applies a force against the other side of the valve seat 693. The bias member 694 is compressed between the valve seat 693 and the hollow relief screw 691. The externally threaded hollow relief screw 691 is seated in threads in the sidewalls of a portion of the cavity 588 proximate to the port 589. The compression on the bias member 694 is adjusted by turning the hollow relief screw 691 to thread in or out of the fourth horizontal passage 587.

When the pressure of the fluid in the vertical passage 475 exceeds a threshold limit controlled by adjusting the hollow relief screw 691, the adjustable relief valve 590 opens and hydraulic fluid flows into the tank/reservoir. When the valve 590 opens, fluid from the vertical passage 475 passes through the hollow opening in the axial center of the hollow relief screw 691, and into the first recess 560*a*.

After the power unit 220 is assembled, the first reservoir cap 362*a* covers and seals the first recess 560*a*, restricting access to the relief valve 590. In order to access, adjust, and calibrate the adjustable relief valve 590 by turning the hollow relief screw 691, the power unit 220 is removed from the frame 102, drained, and disassembled, removing the first reservoir cap 362*a* to expose the internal port 589.

Figure 7:
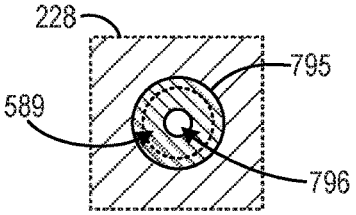
FIG. 7 is a surface view of a tamper-resistant cap disposed over the integrated relief valve from FIGS. 5 and 6, looking down the long axis of the valve.

FIG. 7 illustrates a tamper-resistant cap 795 that may be coupled or disposed over the port 589 and the hollow relief screw 691 as a further precaution, further restricting access to the adjustable relief valve 590. The tamper-resistant cap 795 may be coupled in place, among other ways, by welding it to the valve block 228 over the port 589. The tamper-resistant cap 795 includes a through-hole 796 that has a diameter equal-to or wider than that of the hollow passage through the relief screw 691, with which the through-hole 796 of the cap 795 is aligned. When the relief valve 590 opens, fluid passes through the hollow relief screw 691 and the through-hole 796 of the cap 795, into the tank/reservoir. The presence of tamper-resistant cap 795 further discourages accidental adjustment of the adjustable relief valve 590, even if the power unit 220 is disassembled.

Figure 8:
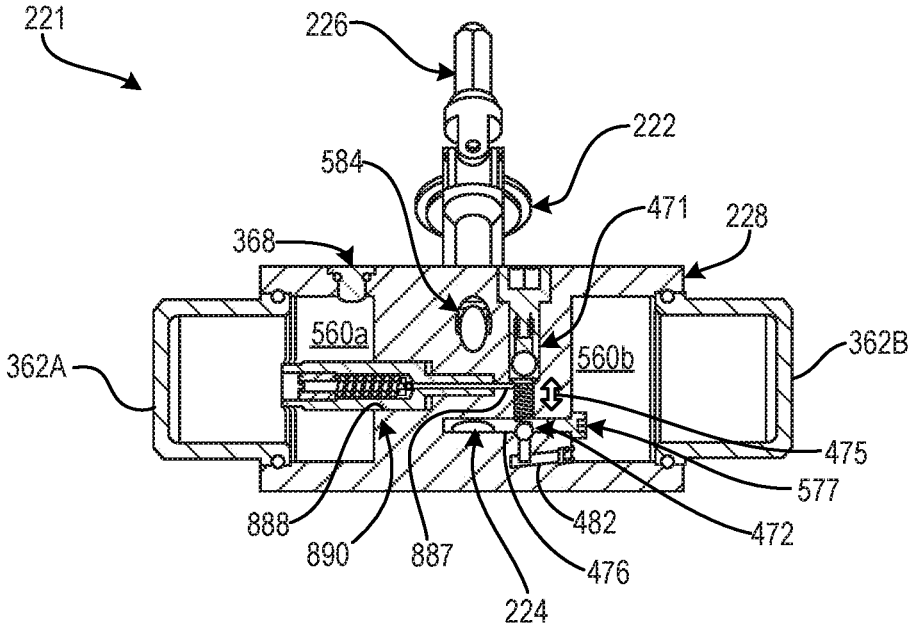
FIG. 8 is a cross-sectional view of the power unit along the line 8-8' in FIG. 3.

FIG. 8 is a cut-away view of the power unit 221 along the line 8-8' in FIG. 3. An internal difference between the power unit 220 and the power unit 221 is that the power unit 220 includes a horizontal relief valve 590 in the valve block 228, whereas the horizontal relief valve 890 in the power unit 221 is a cartridge.

The adjustable cartridge relief valve 890 is inserted in a fourth horizontal passage 887 through the valve block 228. The fourth horizontal passage 887 is a bore through the valve block 228 that connects the first recess 560*a* to the vertical passage 475, intersecting the vertical passage 475 between the ball of the lift cylinder check valve 471 and the first horizontal passage 476. Opposite the vertical passage 475, the fourth horizontal passage 887 widens into a cavity 888 that opens into the first recess 560*a*. The adjustable relief valve cartridge 890 is oriented horizontally in the cavity 888, and may extend out into the first recess 560*a*.

Figure 9:
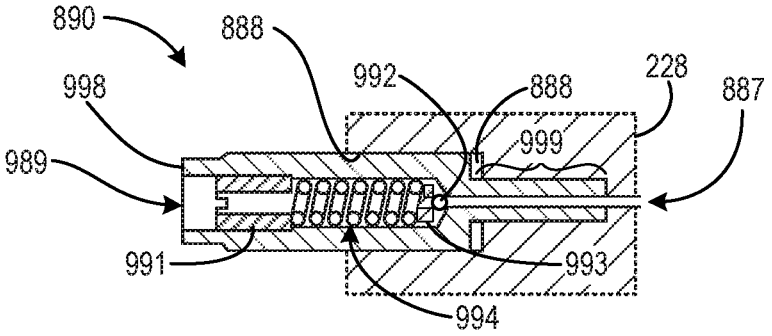
FIG. 9 is an expanded cross-sectional view of an adjustable cartridge relief valve in the power unit of FIG. 8.

FIG. 9 is an expanded view of the fourth horizontal passage 887 and the adjustable cartridge relief valve 890. The adjustable cartridge relief valve 890 includes a cartridge body 998 with a threaded end 999 that mates with threads in the sidewall of the cavity 888. Inside the cartridge body 998 is an externally-threaded hollow relief screw 991 accessible via an axial end-port 989 of the cartridge body 998. When the first recess 560*a* is enclosed and sealed by a first reservoir cap 362*a*, the hollow relief screw 991 is not externally visible nor externally accessible.

The adjustable relief valve 890 includes the hollow relief screw 991, a ball 992, a valve seat 993, and a bias member 994 (such as a spring) within the cartridge body 998. Movement of the ball 992 opens and closes the valve 890. Specifically, the ball 992 selectively closes off an aperture within the cartridge body 998 that opens into the fourth horizontal passage 887, where the fourth horizontal passage 887 narrows at the back of the cavity 888 to connect to the vertical passage 475.

One side of the valve seat 993 presses the ball 992 against the aperture, while the bias member 994 provides a bias force against the other side of the valve seat 993. The bias member 994 is compressed between the valve seat 993 and the hollow relief screw 991. The externally threaded hollow relief screw 991 is seated in threads in the sidewalls of a portion of the cartridge body 998 proximate to the end-port 989. The compression on the bias member 994 is adjusted by turning the hollow relief screw 991 to thread in or out of the cartridge body 998.

When the pressure of the fluid in the vertical passage 475 exceeds a threshold limit controlled by adjusting the hollow relief screw 991, the adjustable cartridge relief valve 890 opens and hydraulic fluid flows into the tank/reservoir. When the valve 890 opens, fluid from the vertical passage 475 passes through the hollow opening in the axial center of the hollow relief screw 991, and into the first recess 560*a*.

After the power unit 221 is assembled, the first reservoir cap 362*a* covers and seals the first recess 560*a*, restricting access to the adjustable cartridge relief valve 890. In order to access, adjust, and calibrate the adjustable cartridge relief valve 890 by turning the hollow relief screw 991, the power unit 221 is removed from the frame 102, drained, and disassembled, removing the first reservoir cap 362*a* to expose the port 989.

Figure 10:
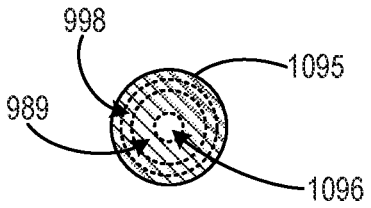
FIG. 10 is a surface view of a tamper-resistant cap disposed over the adjustable relief valve cartridge relief valve from FIGS. 8 and 9, looking down the long axis of the valve.
Figure 11:
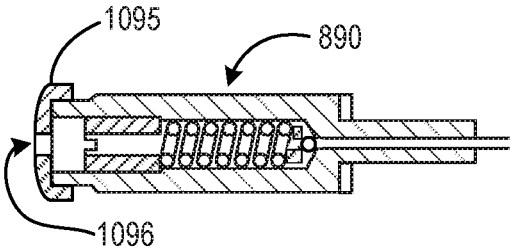
FIG. 11 is a cut-away view of the tamper-resistant cap from FIG. 10 disposed over the adjustable relief valve cartridge relief valve from FIGS. 8 and 9.

FIG. 10 illustrates a tamper-resistant cap 1095 that may be coupled to or disposed over the hollow relief screw 991 as a further precaution, further restricting access to the adjustable relief valve 890. FIG. 11 illustrates a cut-away of the tamper-resistant cap 1095 coupled to the adjustable cartridge relief valve 890. The tamper-resistant cap 1095 may be coupled in place, among other ways, by welding or clamping it to the end of the cartridge valve body 998 over the port 989. The tamper-resistant cap 1095 includes a through-hole 1096 that has a diameter equal-to or wider to that of the hollow passage through the relief screw 991, with which the through-hole 1096 of the cap 1095 is aligned. When the relief valve 890 opens, fluid passes through the hollow relief screw 991 and the through-hole 1096 of the cap 1095, into the tank/reservoir. The presence of tamper-resistant cap 1095 further discourages accidental adjustment of the adjustable relief valve 890, even if the power unit 221 is disassembled.

The bores, ports, and cavities within the power units 220/221 may be formed in the valve block 228 by machining the valve block. Integrated valves, such as valves 471, 472 and 590 may then be assembled and adjusted within in the valve block 228. With the jack power unit 221, the adjustable cartridge relief valve 890 may be separately assembled in the cartridge body 998, and then coupled into the power unit 221.

From the foregoing, it can be seen that there has been described improved jack power units 220/221 which improves the safety of the jack 100 by internalizing and limiting access to the relief valves 590/890. An added benefit of the adjustable cartridge relief valve 890 is that it can be set to the proper pressure prior to being inserted into the power unit valve block 228 during assembly of the power unit 221. The ability to calibrate the power unit valve block 228 separate from the power unit 221 means that the adjustable cartridge relief valve 890 be manufactured and calibrated separately from the power unit 221, and distributed as a pre-calibrated replacement part. The ability to pre-calibrate the adjustable cartridge relief valve 890 prior to insertion into the power unit 221 allows it to be shipped into the field for repairs by qualified technicians without requiring further calibration in the field.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A hydraulic power unit for a jack including a frame, a lifting arm, and a handle pivotally coupled to the frame, the hydraulic power unit comprising:

a valve block including a fluid reservoir, a lift piston assembly extending from a first side and a fluid cylinder disposed in a second side opposite the first side;

a lift piston slidably disposed in the lift piston assembly, and adapted to be mechanically coupled to the lifting arm;

a drive piston slidably disposed in the fluid cylinder, and adapted to be actuated by the handle to pump fluid in the hydraulic power unit;

a vertical passage disposed in the valve block, and containing first and second check valves;

a first horizontal passage in the valve block, fluidly connecting the fluid cylinder to the vertical passage, to communicate fluid between the fluid cylinder and the first check valve, and between the fluid cylinder and the second check valve;

a second horizontal passage in the valve block, fluidly connecting the lift piston assembly to the vertical passage, the first check valve being between the first and second horizontal passages, the first check valve adapted to open and transfer fluid from the fluid cylinder to the lift piston assembly;

an intake passage in the valve block, fluidly connecting the fluid reservoir to the vertical passage, the second check valve being between the first horizontal passage and the intake passage, and the second check valve adapted to close while fluid is pumped from the fluid cylinder by the drive piston, and open in response to the drive piston being withdrawn from the fluid cylinder to transfer fluid from the reservoir to the fluid cylinder;

a third horizontal passage in the valve block, connecting the fluid reservoir to the vertical passage between the first check valve and the first horizontal passage; and a third check valve horizontally oriented and disposed in the third horizontal passage, the third check valve is adapted to open in response to pressure in the first horizontal passage exceeding a threshold limit, the third check valve includes a relief screw that is rotatable to set the threshold limit, wherein the fluid reservoir encloses and restricts access to the relief screw.

2. The hydraulic power unit of claim 1, wherein the third check valve is integrated within the third horizontal passage, with external threads of the relief screw seated in threads in a sidewall of the third horizontal passage.

3. The hydraulic power unit of claim 2, further comprising a cap with a through-hole disposed over the relief screw.

4. The hydraulic power unit of claim 1, wherein the third check valve is part of a cartridge at least partially inserted into the third horizontal passage.

5. The hydraulic power unit of claim 4, further comprising a cap with a through-hole disposed over the relief screw.

6. The hydraulic power unit of claim 1, wherein the fluid reservoir includes:

first and second recesses in the valve block and disposed on opposite sides of a long axis of the lift piston assembly;

a first cap adapted to enclose the first recess;

a second cap adapted to enclose the second recess; and a through-bore in the valve block, fluidly connecting the first and second recesses.

7. A hydraulic power unit for a jack, and including a fluid reservoir, a valve block, a lift piston assembly coupled to a first side of the valve block, and a fluid cylinder coupled to a second side of the valve block, the hydraulic power unit comprising:

a vertical passage in the valve block, and including first and second check valves;

a first horizontal passage in the valve block, fluidly connecting the fluid cylinder to the vertical passage to communicate fluid between the fluid cylinder and the first and second check valves;

a second horizontal passage in the valve block, fluidly connecting the lift piston assembly to the vertical passage above the first check valve, the first check valve is disposed between the first and second horizontal passages;

an intake passage in the valve block, fluidly connecting the fluid reservoir to the vertical passage below the second check valve, the second check valve is disposed between the first horizontal passage and the intake passage;

a third horizontal passage in the valve block, fluidly connecting the fluid reservoir to the vertical passage between the first check valve and the first horizontal passage; and a third check valve horizontally oriented and at least partially disposed in the third horizontal passage, the third check valve is adapted to open in response to pressure in the first horizontal passage exceeding a threshold limit, the third check valve includes a relief screw that is rotatable to set the threshold limit, wherein the fluid reservoir encloses access to the relief screw.

8. The hydraulic power unit of claim 7, wherein the third check valve is integrated within the third horizontal passage, with external threads of the relief screw seated in threads in a sidewall of the third horizontal passage.

9. The hydraulic power unit of claim 8, further comprising a cap with a through-hole disposed over the hollow relief screw.

10. The hydraulic power unit of claim 7, wherein the third check valve is part of a cartridge at least partially inserted into the third horizontal passage.

11. The hydraulic power unit of claim 10, further comprising a cap with a through-hole disposed over the relief screw.

* * * * *